United States Patent [19]

Coxhill

[11] 4,037,800

[45] July 26, 1977

[54] GYRATORY CRUSHER HAVING ANTISPIN DEVICE FOR HEAD

[75] Inventor: Major Coxhill, Appleton, Wis.

[73] Assignee: Allis-Chalmers Corporation, Milwaukee, Wis.

[21] Appl. No.: 693,785

[22] Filed: June 8, 1976

[51] Int. Cl.[2] ..... B02C 2/04

[52] U.S. Cl. ..... 241/213; 241/215

[58] Field of Search ..... 241/207-216

[56] References Cited

U.S. PATENT DOCUMENTS

| | | | |
|---|---|---|---|
| 2,579,238 | 12/1951 | Lippmann | 241/216 X |
| 2,829,842 | 4/1958 | Messinger | 241/208 |
| 3,227,381 | 1/1966 | Golucke et al. | 241/208 |
| 3,539,119 | 11/1970 | Cook | 241/215 |
| 3,908,915 | 9/1975 | Milenkovic | 241/216 X |

*Primary Examiner*—Roy Lake
*Assistant Examiner*—Howard N. Goldberg
*Attorney, Agent, or Firm*—Robert C. Jones

[57] ABSTRACT

In a gyratory crusher the crusher head is mounted on a drive shaft which is driven by an eccentric. The eccentric is continually rotated to cause the head to gyrate for effecting the crushing of material. an antispin arrangement is provided to prevent rotation of the crusher head in the same direction as the eccentric under idling conditions or no load conditions. The antispin device includes a pair of ratchets one of which is coupled to the shaft and the other of which is formed on the end face of a piston which is held in the counterbore of the drive shaft by a spring. A rectangular torsion rod extends through the center of the piston into a clearance hole bored in the crusher head drive shaft. The top of the torsion rod is anchored in the spider cap of the crusher.

3 Claims, 4 Drawing Figures

GYRATORY CRUSHER HAVING ANTISPIN DEVICE FOR HEAD

BACKGROUND OF THE INVENTION

The invention pertains to gyratory crushers for reducing material to desired sizes. More particulary, the invention pertains to a gyratory cone type crusher in which the crushing head is carried on a shaft which is rotatably driven by an eccentric so that the head is gyrated upon rotation of the eccentric. A problem which is frequently encountered in gyratory crushers is the fact that the cone crusher head in running idle or no load condition tends to rotate with the eccentric. The cause of the spinning is the frictional drag that occurs between the crusher head shaft and the eccentric drive mechanism. If the spinning is excessive, it can damage the contact oil seals and bearings. Also, when material is fed into the crusher in which the crusher head is spinning, excessive wear of the crushing surfaces can occur due to skidding between the surfaces and the material. To prevent such crusher head spinning many approaches have been taken with varying degrees of success.

Examples of crushers in which antispin devices are incorporated are shown in U.S. Pat. Nos. 1,960,980; 3,207,449; 3,473,743; 3,539,119 and 3,743,193.

However, in a crusher where the crusher head shaft is adjustable, the anchor point of the antispin device can be fixed to the stationary frame. In this arrangement, provision must be made to allow the antispin device to work for all possible crusher shaft positions. When the crusher is idling the crusher head shaft tends to spin in the same direction as the drive eccentric rotates. When the crusher is working the crusher head shaft rotates slowly in the opposite direction with respect to the direction in which the drive eccentric is rotating. Thus, an antispin device must allow for this reverse rotation.

SUMMARY OF THE INVENTION

The present invention includes among its objects the provision of an improved means for an antispin device where is operable in all possible crusher head shaft positions and allows for the reverse rotation of the shaft under load.

In the present invention a piston is held in a counterbore of the crusher head shaft by means of a spring and retaining plate. The bottom face of the piston is one-half of a ratchet. The other half of the ratchet is a plate which is fixed to the crusher head shaft. A torsion rod which is rectangular in cross-section extends through the center of the piston and extends beyond the plate into a clearance hole bored into the crusher head shaft. The top of the torsion rod is anchored to the stationary spider cap.

DESCRIPTION OF THE INVENTION

Figure 1:
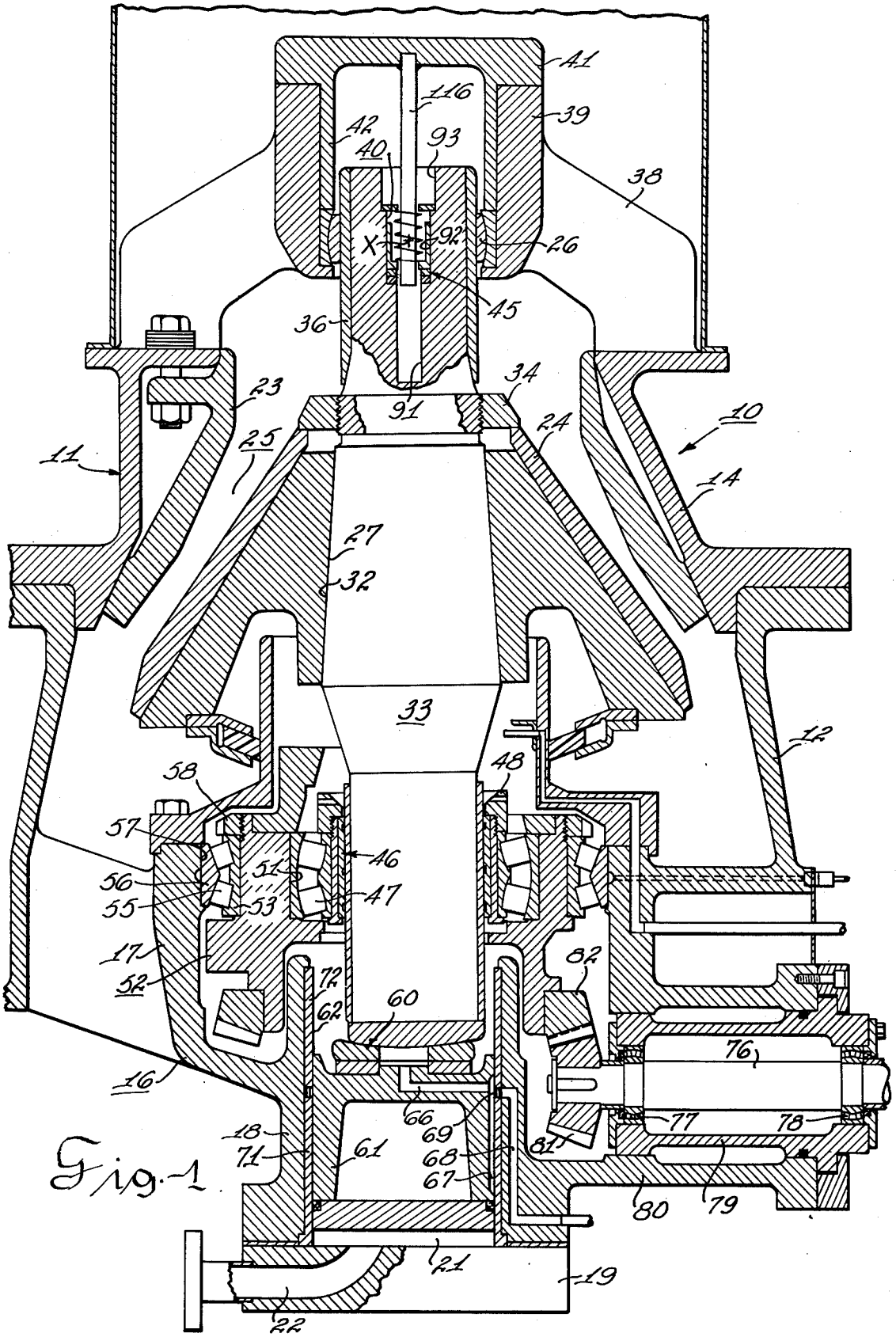
FIG. 1 is a view in vertical section through a gyratory crusher in which the present invention is embodied.

Referring to FIG. 1 of the drawing, there is shown a gyratory crusher 10 having a frame generally indicated at 11 and including a lower frame section 12 and an upper frame section 14. The lower frame section 12 includes a fixed vertical hub 16 having an upper portion 17 and a lower portion 18. The lower hub portion 18 is provided with a closure plate 19 which forms sealed chamber 21. The closure plate 19 also provides for a hydraulic fluid inlet 22 which communicates with expansible chamber 21.

The upper frame section 14 opens upwardly and has secured therein a concave ring 23 which is supported in coaxial relationship above the hub 16. A generally conical crushing head 24 projects upwardly within the concave ring 23 to define therebetween a crushing chamber 25. The crushing head 24 is supported and arranged with its central axis inclined relative to and intersecting with the vertical axis of the hub 16 and concave ring 23. The axes intersect at a point X in a horizontal plane which passes through the middle of a bearing 26. The crushing head 24 has a central upwardly tapering bore 27 which is adapted to receive a tapered or frusto-conical portion 32 of a crusher shaft 33.

A nut 34 is threadedly engaged on the crusher shaft 33 at a position adjacent the upper end of the crusher head 24 and serves to lock the crusher head in operative position on the shaft 33. The upper portion of the crusher shaft 33 is fitted with a bearing sleeve 36 and is received in the pivot bearing member 26. A spider 38 being an integral part of the top of the frame 11 presents an axial hub 39, the axis of which coincides with the axis of the frame. The hub 39 serves as a housing for the pivot bearing 26. A cap 41 having an axially extending sleeve portion 42 is secured to the outer end face of the hub 39 and locks the outer race of the pivot bearing 26 in the hub. A crusher head antispin device 45 is accommodated in a suitable stepped bore 40 formed in the upper end of the crusher head shaft 33.

The lower end of the crusher head shaft 33 is provided with a bearing sleeve assembly 46 which is journalled in the inner race of a radial bearing 47. A nut 48 threadedly engaged on the outer member of the bearing assembly 46 is formed with an axially extending sleeve portion which abuts the inner race of the radial bearing 47 to lock it in position. The outer race of radial bearing 47 is supported in a bore 51 of a drive eccentric 52. A bearing surface formed on the exterior of the drive eccentric 52 receives the inner race 53 of a radial bearing 55. The outer race 56 of the bearing 55 is disposed in a circular seat 57 formed on the upper portion 17 of the vertical hub 16. A nut 58 is threadedly engaged on a circular extension of the drive eccentric 52 and is disposed to abut the inner race 53 of the bearing 55.

An axial thrust bearing 60 is disposed beneath the crusher head shaft 33 between the lower axial end face thereof and a piston 61 within a cylinder 62 defined by the closure plate 19. Lubrication of the thrust bearing 60 is accomplished through a communicating oil passage 66 formed in the head of the piston 61. The passage 66 communicates with a vertical oil groove 67 in the exterior surface of the piston. Lubricating oil from a source (not shown) is supplied to the vertical groove 67 via a passage 68 that connects with the vertical groove 67 via a port 69 drilled in the sleeve liner 71 of the cylinder 62.

To drive the crusher, a pinion gear drive shaft 76 is journalled in bearings 77 and 78 carried by a bearing carrier 79 which is disposed within a laterally extending hub 80 formed with the lower portion 18 of the frame section 16. The shaft 76 is driven by any suitable source of power. At its inner end, drive shaft 76 carries a pinion drive gear 81 that is in meshing engagement with a gear 82 connected to the drive eccentric 52. Thus, shaft 33 is free to move axially up and down within the bearing sleeve assembly 46 while still maintaining its gyratory drive connection with the drive eccentric 52.

In the operation of the crusher 10, power is applied to drive the pinion 81 and rotate the gear 82. This effects rotation of the drive eccentric 52 which rotates in an orbit about the vertical axis of the crusher. Thus, the axis of the crusher head shaft 33 is driven in a gyratory motion and transcribes a cone about the central vertical axis of the crusher. This motion provides the crushing action of head 24 in the crushing chamber 25. As the crusher head shaft 33 is driven in its gyratory motion about the central vertical axis of the crusher, crushing forces which are the result of stone being broken between the head 24 and the concave 23 develop forces which react on the head 24. These forces cause the head 24 and thereby the shaft 33 to rotate slowly in the opposite direction to the eccentric 52 rotation about the axis of the crusher head shaft 33 while the crusher head shaft is being bodily moved in a gyratory path of travel about the central vertical axis of the crusher.

Vertical support and positioning of the crusher head 24 for adjusting the opening of the crushing chamber 25 is accomplished by hydraulic fluid under pressure. For this purpose, hydraulic fluid under pressure is supplied to the expansible chamber 21 via the passage 22 in the closure plate 19. The fluid under pressure in chamber 21 reacts on the piston 61 elevating the shaft 33 and thereby the crusher head 24 (or lowers the assembly) as desired.

Figure 3:
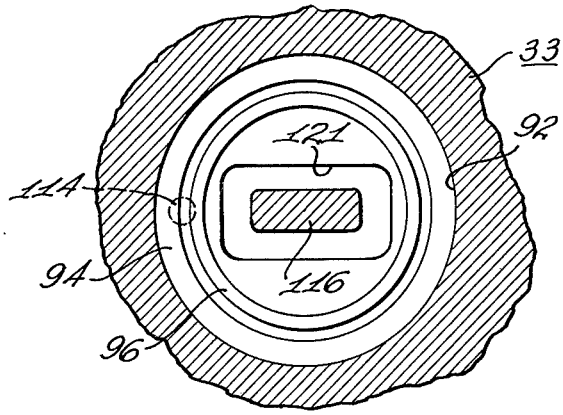
FIG. 3 is a view in horizontal section taken in a plane represented by the line III—III in FIG. 2; and, FIG. 4 is an enlarged developed view of the ratchet plates showing tooth arrangements.
Figure 2:
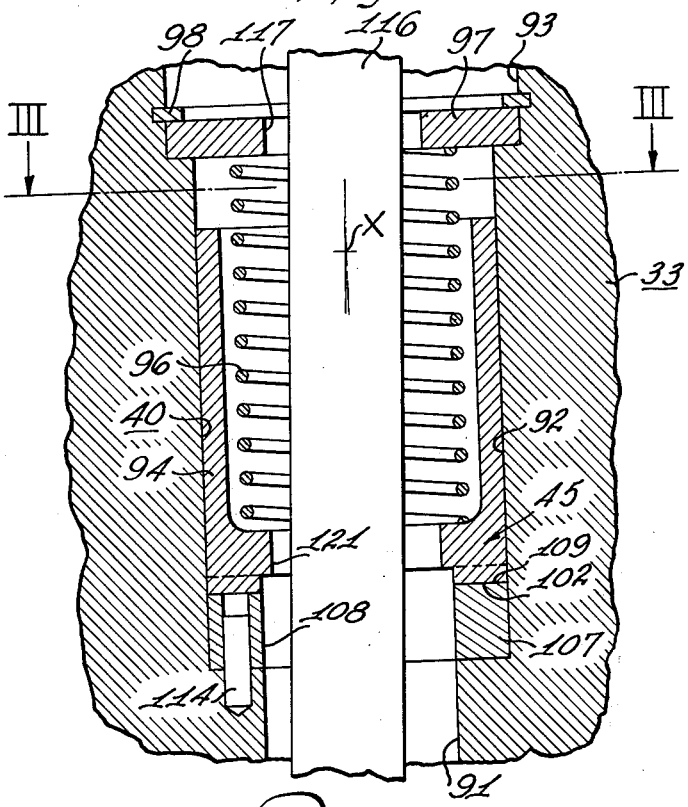
FIG. 2 is an enlarged view in vertical section through the antispin device of FIG. 1.
Figure 4:
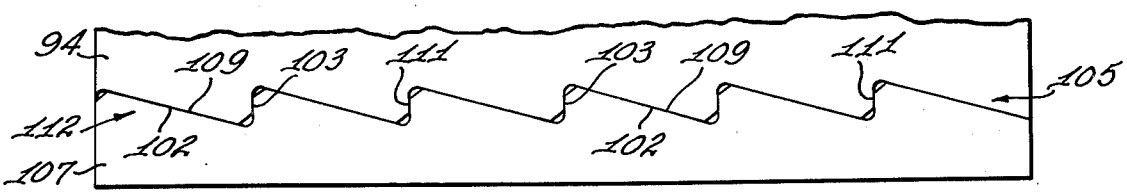

As previously mentioned, the gyratory crusher 10 is provided with an antispin device 45 to prevent undersirable spinning of the crusher head 24. As shown in FIGS. 2, 3 and 4, the crusher head shaft 33 is provided with an axially extending bore 91 having a counterbore 92. The counterbore 92 is, in turn, counterbored as at 93. A cup-shaped piston 94 is slidably disposed within the counterbore portion 92 and held therein by operation of a spring 96. The spring 96 is retained within the piston 94 by means of a retainer washer 97 that is disposed at the bottom of the bore 93 adjacent the upper end of the counterbore 92. A snap ring 98 operates to lock the washer 97 in position.

The bottom or lower axial end face of the piston 94 is formed with sloping surfaces 102 presenting vertical surfaces 103 and serves as a ratchet 105. A plate 107 having an axial opening 108 is formed with sloping surfaces 109 presenting vertical surfaces 111 and serves as a ratchet 112 complementary to the piston ratchet 105. The ratchet plate 107 is restrained against independent rotation within the bore 92 by operation of a dowel pin 114 and is secured to the crusher head shaft by means of screws (not shown). A torsion rod 116 of rectangular configuration in cross-section is secured as by being welded in the spider cap 41. The torsion rod 116 extends downwardly through a suitable opening 117 in the retainer washer 97 and through a rectangular opening 121 in the bottom face of the piston 94 into the clearance bore 91. As can be seen, the rectangular opening 121 in the bottom face of the piston 94 is sized to give clearance between all sides thereof and the torsion rod 116 in all vertical positions of the crusher head shaft 33. While the opening 121 is sized to give clearance to the torsion rod 116 in all angular positions of the shaft 33, its size is such that only a limited angular movement of the piston 94 with the shaft 33 will occur; such movement being limited by the engagement of the corners of the torsion rod with the side walls of the opening 121.

Operation of the antispin device 45 will now be given and for this purpose it is assumed that the crusher 10 is idling with no feed being supplied. The crusher head shaft 33 will begin to rotate with the drive eccentric 52. The piston 94 will rotate with the crusher head shaft 33 for substantially 15° until it is stopped by the torsion rod 116 which will then be in a diagonal position within the rectangular opening 121 in the piston 94. The hand or direction of nonrotation faces of the ratchet teeth are such that when the crusher head shaft 33 tries to rotate in the same direction as the drive eccentric 52 the vertical surfaces or teeth 103 and 111 of the ratchets 105 and 112, respectively, abut to prevent the rotation of the crusher head shaft 33 with the eccentric 52. Thus, the crusher head shaft 33 is prevented from spinning even though its vertical position may be changed.

Assuming now that material is fed into the crusher 10, the crusher head shaft 33 begins to rotate in the opposite direction with respect to the direction in which the drive eccentric 52 is rotating. The piston 94 rotates with the crusher head shaft 33 until the torsion rod 116 engages the opposite side wall of the rectangular opening 121 in the bottom face of the piston 94. At this point the ratchet members 105 and 112 will move on their sloping or incline surfaces 102 and 109, respectively, relative to each other allowing rotation therebetween. Due to the tooth slope or incline the spring 96 will compress. Thus, as the teeth 103 and 111 move over each other the piston 94 will rise and fall thus allowing the crusher head shaft 33 to rotate in a direction opposite to the direction of rotation of the drive eccentric 52.

The embodiments of the invention in which an exclusive property or privilege is claimed are defined as follows:

1. In a gyratory crusher having a frame including a spider, a crusher head carried by a shaft which is supported by the frame for rotation about its own axis and for gyratory movement about the axis of the frame and a drive eccentric operable to effect the gyratory movement of the shaft and crusher head:

an axial bore in the shaft, said axial bore having a counterbore;

a first ratchet plate having an axial opening the diameter of which is substantially equal to the diameter of said bore in the shaft, said first ratchet being disposed at the bottom of the counterbore and secured therein to rotate with the shaft;

a second ratchet plate disposed in the counterbore in operating engagement with said first ratchet plate;

means in said second ratchet plate defining a non-circular opening therethrough;

a torsion rod of noncircular configuration of cross-section secured to the spider and depending downwardly therefrom into said axial bore formed in the shaft, said torsion rod extending through the openings in said first and second ratchet plates, said opening in said second ratchet plate being sized to give clearance to said torsion rod in all vertical positions of the shaft but sufficiently small enough wherein upon limited rotation of said second ratchet plate the sides of the opening engage with said torsion rod to stop further rotation of said second ratchet whereupon said first and second ratchet plates in cooperation with said torsion rod operate to prevent the further rotation of the shaft in the direction in which the drive eccentric is rotating; and, a spring confined within the counterbore and acting against said second ratchet plate to bias said second ratchet plate into operating engagement with said first ratchet plate, said spring yielding when the crusher is under load to permit the shaft to rotate in a direction opposite to the direction in which the drive eccentric is rotating.

2. A gyratory crusher according to claim 1 including a cup-shaped piston disposed within the counterbore;

said second ratchet plate being formed on the bottom face of said piston; and, said spring is disposed in said cup-shaped piston and operates to urge said piston downwardly to effect an operative engagement of the ratchet formed on the bottom surface thereof with said first plate.

3. In a gyratory crusher having a frame, a crusher head carried by a shaft which is supported by the frame for rotation about its own axis and for gyratory movement about the axis of the frame, and a drive eccentric operable to effect the gyratory movement of the shaft and crusher head;

a first ratchet member secure to the shaft;

a second ratchet member disposed in co-operating relationship with said first ratchet member;

a bar having one end secured to the frame and having its opposite end in position to be engageable with said second ratchet member upon limited rotation of said second ratchet member with respect to said first ratchet member in the direction in which the shaft is rotating to stop the further rotation of said second ratchet member and thereby prevent rotation of the shaft in the direction in which the drive eccentric is rotating when the crusher is idling; and, a spring carried by the shaft and operable on said second ratchet member to yieldably maintain said second ratchet member in engagement with said first ratchet member;

whereby the shaft and thereby the crusher head are allowed to rotate in a direction opposite to the direction that the drive eccentric is rotating when the crusher is under load.

* * * * *